US007007918B2

(12) United States Patent
Kawai et al.

(10) Patent No.: US 7,007,918 B2
(45) Date of Patent: Mar. 7, 2006

(54) VALVE OPENING-CLOSING TIMING CONTROL DEVICE

(75) Inventors: Yoshiyuki Kawai, Nagoya (JP); Masaki Kobayashi, West Bloomfield, MI (US); Shigeru Nakajima, Anjo (JP)

(73) Assignee: Aisin Seiki Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 10/927,393

(22) Filed: Aug. 27, 2004

(65) Prior Publication Data

US 2005/0087713 A1 Apr. 28, 2005

(30) Foreign Application Priority Data

Aug. 28, 2003 (JP) ..... 2003-305538
Aug. 25, 2004 (JP) ..... 2004-245400

(51) Int. Cl.
*F01L 1/344* (2006.01)

(52) U.S. Cl. ..... 251/89; 123/90.12; 123/90.15; 123/90.31

(58) Field of Classification Search ..... 251/89, 251/89.5; 123/90.15–90.18, 90.12, 90.31
See application file for complete search history.

(56) References Cited

U.S. PATENT DOCUMENTS

| | | | | |
|---|---|---|---|---|
| 4,858,572 | A | 8/1989 | Shirai et al. | |
| 6,418,897 | B1 | 7/2002 | Urban et al. | |
| 6,477,999 | B1 | 11/2002 | Markley | |
| 2003/0010303 | A1 * | 1/2003 | Kanada et al. | 123/90.17 |
| 2003/0019449 | A1 * | 1/2003 | Hiratsuka et al. | 123/90.17 |
| 2004/0055551 | A1 * | 3/2004 | Maeyama et al. | 123/90.17 |

FOREIGN PATENT DOCUMENTS

| | | |
|---|---|---|
| JP | 2000-052425 | 8/1998 |
| JP | 2002-155713 | 11/2000 |
| JP | 2003-013713 | 6/2001 |

OTHER PUBLICATIONS

European Patent Office Search Report dated Dec. 1, 2004.

* cited by examiner

*Primary Examiner*—J. Casimer Jacyna
(74) *Attorney, Agent, or Firm*—Reed Smith LLP; Stanley P. Fisher, Esq.; Juan Carlos A. Marquez, Esq.

(57) ABSTRACT

A valve opening-closing timing control device includes a housing member rotating together with one of a cam shaft and a crank shaft of a combustion engine, a rotor member rotatably attached to said housing member; and rotating together with the other of said crank shaft and said cam shaft, a hydraulic pressure chamber formed between said housing member and said rotor member, the hydraulic pressure chamber being divided into an advance angle hydraulic chamber and a retard angle hydraulic chamber by a vane integrally provided with said rotor member, a lock mechanism including a lock member movably provided at the housing member and a receiving portion formed at said rotor member for receiving the lock member, whereby the lock mechanism restricts a relative rotation between the rotor member and the housing member by advancing the lock member into the receiving portion and allows the relative rotation between the rotor member and the housing member by retracting the lock member from the receiving portion, a hydraulic pressure circuit for supplying hydraulic fluid to said advance angle hydraulic chamber, said retard angle hydraulic chamber, and said lock mechanism, and a projecting portion formed at a bottom of said receiving portion and including a top end face smaller than a sectional area of said lock member.

13 Claims, 3 Drawing Sheets

VALVE OPENING-CLOSING TIMING CONTROL DEVICE

CROSS REFERENCE TO RELATED APPLICATIONS

This application is based on and claims priority under 35 U.S.C. § 119 to Japanese Patent Application 2003-305538, filed on Aug. 28, 2003, the entire content of which is incorporated herein by reference.

1. Field of the Invention

The present invention relates to a valve opening-closing timing control device for controlling opening-closing timing of an intake and exhaust valve of an internal combustion engine.

2. Background

Conventionally, there is a valve opening-closing timing control device including a housing member rotatable together with a crank shaft of a combustion engine, a rotor member integrally rotatable with the cam shaft, the rotor member relatively rotatably attached to the housing member, a hydraulic pressure chamber formed between the housing member and the rotor member and divided into two chambers as an advance angle hydraulic chamber and a retard angle hydraulic chamber by a vane provided together with the rotor member, a lock mechanism for restricting relative rotation by advancing a lock member provided in the housing member movably in a receiving portion formed in the rotor member and enabling relative rotation by retracting from the receiving portion, and a hydraulic pressure circuit for supplying hydraulic fluid to the advance angle hydraulic chamber, the retard angle hydraulic chamber, and the lock mechanism, in which the lock mechanism is released by retracting the lock member from the receiving portion by supplying hydraulic fluid flowing into the advance angle hydraulic chamber or the retard angle hydraulic chamber to the receiving portion (JP2000-52425A2).

Further, there is the other type of valve opening-closing timing control device for releasing the lock mechanism by retracting the lock member from the receiving portion by supplying hydraulic fluid to the advance angle hydraulic chamber or the retard angle hydraulic chamber through the receiving portion (JP2003-13713A2).

These devices can avoid an unstable lock condition between the rotor member and the housing member under the condition in which hydraulic pressure cannot be controlled at the time of starting-an engine, or the like, by providing the receiving portion for receiving the lock member in the rotor member, advancing a plate type lock member into the receiving portion, and engaging the receiving portion with the lock member. This lock member is advanced into the receiving portion by pushing toward the receiving portion side using an biasing member. Relative rotation is started after the lock condition (a lock mechanism) is released by retracting the lock member from the receiving portion using hydraulic fluid (hydraulic pressure). In order to start rotation of the rotor relative to the housing member, the lock member should be retracted from the receiving portion. Thus, a condition of the lock member is changed from that of the lock member engaged with the receiving portion, in other words, that the lock member advanced into the receiving portion.

However, in case that the lock member is advanced into the receiving portion, since the whole area of a top end portion of the lock member contacts to a bottom portion of the receiving portion, time for retracting the lock member from the receiving portion is long because hydraulic pressure is insufficiently applied to the lock member and the power for separating the lock member from the bottom portion is very small. Accordingly, before sufficient hydraulic pressure for retracting the lock member from the receiving portion is applied to the lock member, the housing member and the rotor member start relatively rotating and the lock member is held between the rotor member and the housing member. In other words, because the lock member is insufficiently retracted, the lock is insufficiently released.

A need thus exists for a valve opening-dosing timing control device which can avoid an insufficient lock release caused by an insufficient retracting of the lock member being held between the rotor member and the housing member when the rotor member relatively rotates to the housing member.

SUMMARY OF THE INVENTION

According to an aspect of the present invention, a valve opening-closing timing control device includes a housing member rotating together with one of a cam shaft and a crank shaft of a combustion engine, a rotor member rotatably attached to said housing member; and rotating together with the other of said crank shaft and said cam shaft, a hydraulic pressure chamber formed between said housing member and said rotor member, the hydraulic pressure chamber being divided into an advance angle hydraulic chamber and a retard angle hydraulic chamber by a vane integrally provided with said rotor member, a lock mechanism including a lock member movably provided at the housing member and a receiving portion formed at said rotor member for receiving the lock member, whereby the lock mechanism restricts a relative rotation between the rotor member and the housing member by advancing the lock member into the receiving portion and allows the relative rotation between the rotor member and the housing member by retracting the lock member from the receiving portion, a hydraulic pressure circuit for supplying hydraulic fluid to said advance angle hydraulic chamber, said retard angle hydraulic chamber, and said lock mechanism, and a projecting portion formed at a bottom of said receiving portion and including a top end face smaller than a sectional area of said lock member.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

Figure 1:
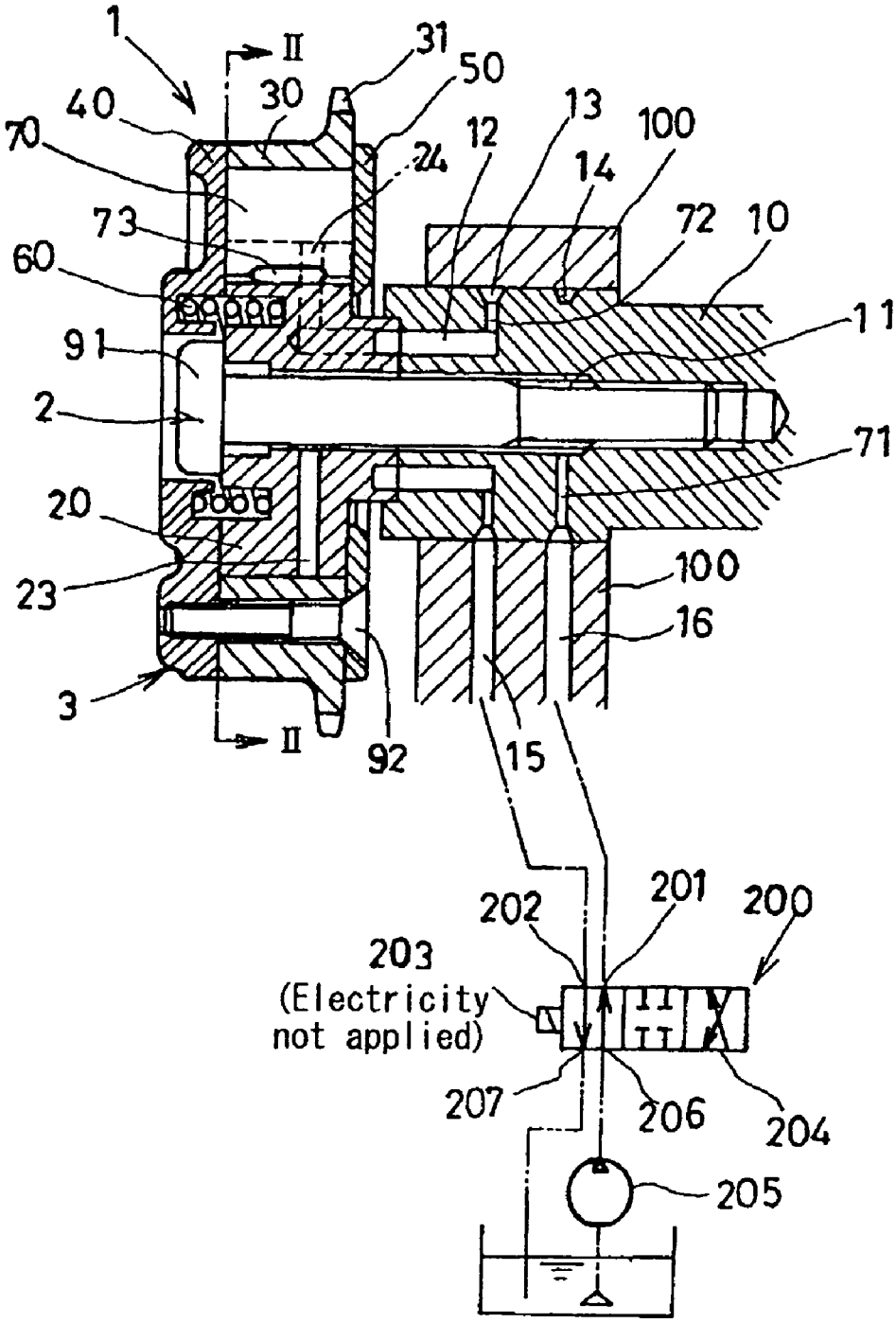
FIG. 1 shows a longitudinal section profile of a valve opening-closing timing control device according to an embodiment of the present invention.

An embodiment of the present invention will be explained with reference to drawings as follows.

A valve opening-closing timing control device 1 of FIGS. 1 to 5 includes a valve opening-closing rotor member 2 structured by a cam shaft 10, which is supported rotatably by a cylinder head 100 of an internal combustion engine, and a rotor 20 assembled integrally into a top portion of the cam shaft 10. Further, the valve opening-closing timing control device 1 includes a housing member 3 including a housing 30, a front plate 40, and a rear plate 50, which are assembled so as to be relatively rotatable to a rotor 20. A plurality of timing sprockets 31 are integrally formed at the outside of the housing 30. Further, the valve opening-closing timing control device 1 includes a torsion spring 60 provided between the rotor 20.and the front plate 40, four vanes 70 attached to the rotor 20, and a lock plate (lock member) 80 attached to the housing 30.

Figure 2:
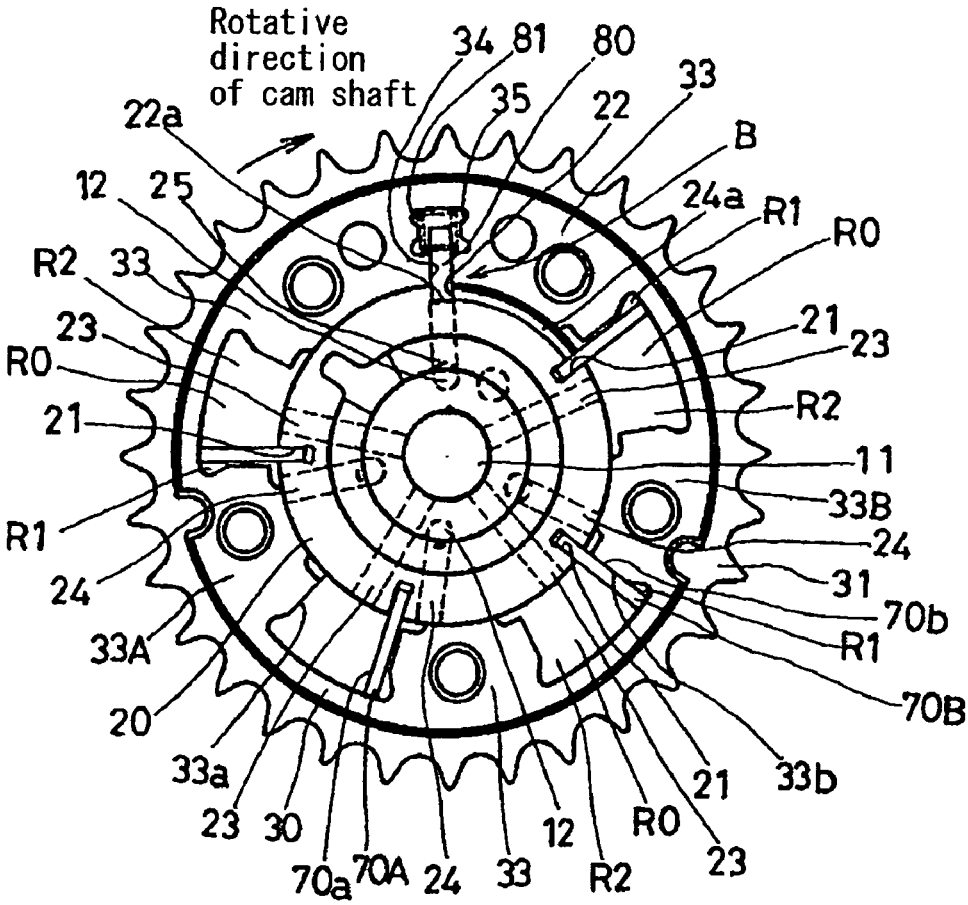
FIG. 2 shows a cross-sectional view taken on line II—II of FIG. 1 showing the mostly retard angle condition of the valve opening-closing timing control device.

As is well known, the rotating force is transmitted to a plurality of timing sprockets 31 in the clockwise direction, which is shown in FIG. 2 as the cam shaft rotating direction, through a timing chain and a crank sprocket from a crank shaft, not shown in the drawing.

The cam shaft 10 includes a well known cam (not shown) for opening and closing an intake valve (not shown). An advance angle passage (hydraulic pressure circuit) 12 and a retard angle passage (hydraulic pressure circuit) 11 are provided at the inside of the cam shaft 10. The advance angle passage 12 and the retard angle passage 11 are extended in axial direction of the cam shaft 10. The retard angle passage 11 is connected to the first connection port 201 of a directional control valve 200 through a ring shape groove 14 and a passage 71 provided in the cam shaft 10 in the axial direction and a connection passage 16 provided in the cylinder head 100. Further, the advance angle passage 12 is connected to the second connection port 202 of the directional control valve 200 through a connection passage 15 provided in the cylinder head 100 and a ring shape groove 13 and a passage 72 provided in the cam shaft 10 in the axial direction.

The directional control valve 200 is a publicly known valve for moving a spool 204 against biasing force of a spring, not shown in the drawing, by applying electricity to a solenoid 203. In case electricity is not applied to the solenoid 203, as shown in FIG. 1, a supplying port 206 connected to an hydraulic pump 205 driven by the internal combustion engine is connected to the connecting port 201, and the second connecting port 202 is connected to a discharge port 207. Further, in case electricity is applied to the solenoid 203, the supplying port 206 is connected to the second connecting port 202, and the connecting port 201 is connected to the discharge port 207. Therefore, when electricity is not applied to the directional control valve 200, hydraulic fluid (hydraulic pressure) is supplied to the retard angle passage 11. On the other hand, when electricity is applied to the directional control valve, hydraulic fluid (hydraulic pressure) is supplied to the advance angle passage 12. Thus, hydraulic liquid (oil pressure) is supplied to the retard angle passage 11 when electricity is not applied to the directional control valve 200, and hydraulic liquid (hydraulic pressure) is supplied to the advance-angle passage 12 when electricity is applied to the directional control valve 200. The directional control valve 200 is controlled by varying the duty ratio, that is, the ratio of electrified time to non-electrified time per unit time. If the directional control valve 200 is controlled by 50% of duty ratio, the first and second ports 201 and 202 are not connected to the supply port 206 and the discharge port 207 relatively.

The rotor 20 is fixed integrally with the cam shaft 10 by a fixing bolt 91. Further, as shown in FIG. 2, four vane grooves 21 and a receiving portion 22 are formed in the rotor 20. The receiving portion 22 penetrates the rotor 20 in the axial direction. Further, plural hydraulic fluid passages including four retard angle hydraulic passages 23 (hydraulic pressure circuits) extending in a radial direction and connected to the retard angle passage 11, three advance angle hydraulic passages 24 (hydraulic pressure circuits) and one hydraulic fluid groove 24*a* (hydraulic pressure circuit) connected to the advance angle passage 12, and one lock hydraulic passage 25 (hydraulic passage: hydraulic pressure circuit) connecting a bottom portion 22*f* of the receiving portion 22 to the advance angle passage 12, are provided in the rotor 20.

Figure 3:
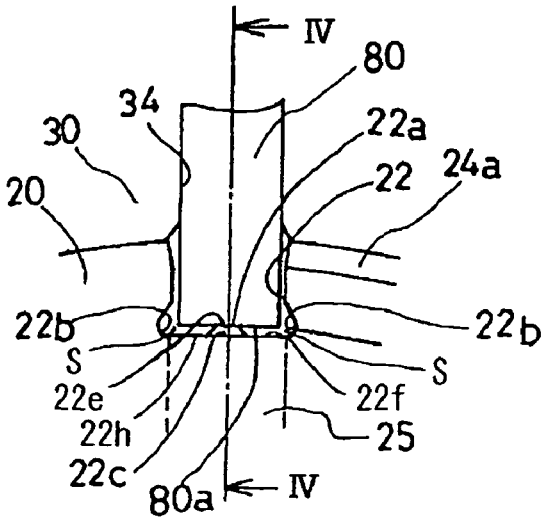
FIG. 3 shows an expanded view of the portion B of FIG. 2.
Figure 5:
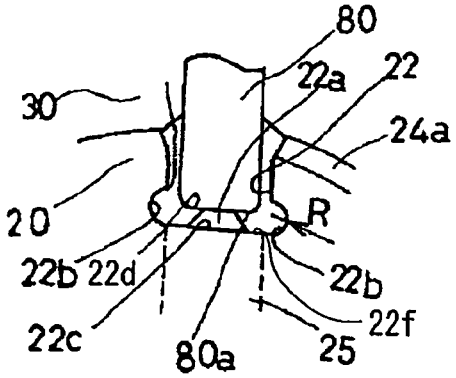
FIG. 5 is an expanded view according to the embodiment that a hydraulic pressure groove 22*c* has a round shape shown in FIG. 3.
Figure 6:
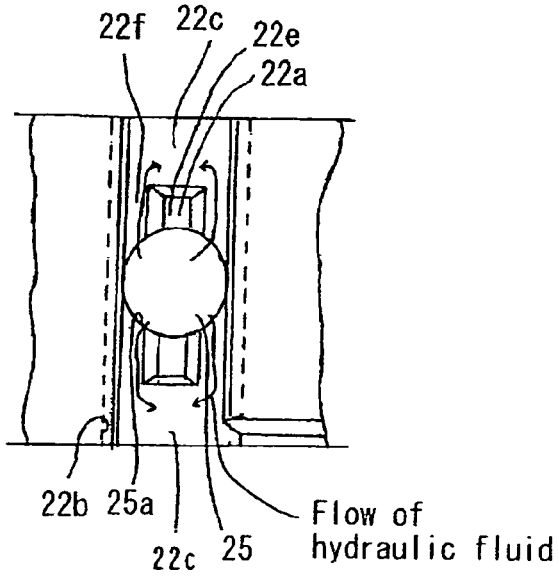
FIG. 6 shows an expanded view shown from the outside of the radial direction of the receiving portion of the rotor member shown in FIG. 3.

As shown in FIG. 3 as an expanded illustration of the portion B of FIG. 2, a projecting portion 22*a* projecting from a bottom portion 22*f* is formed in the bottom of the receiving portion 22. The projecting portion 22*a* has a trapezoidal cross section. The lock hydraulic passage 25 is connected through an opening portion 25*a* in the bottom portion 22*f* of the receiving portion 22. The circumferential width (in the circumferential direction of the rotor 20) of the opening portion 25*a* is wider than the circumferential width of the projecting portion 22*a* (a top end face 22*e*). The top end face 22*e* of the projecting portion 22*a* contacts with the lock plate 80. The circumferential direction width of the top end face 22*e* is smaller than the circumferential direction width of the lock plate 80. Further, the area of the top end face 22*e* is smaller than the sectional area of the lock plate 80. More preferably, the area of the top end face 22*e* is smaller than the area of an end portion 80*a* of the lock plate 80. When the lock plate 80 contacts with the top end face 22*e*, a space S is formed around the projecting portion 22*a*. Accordingly, hydraulic fluid flows into the space S and the lock plate 80 is separated from the projecting portion 22*a*. Further, hydraulic pressure grooves 22*b* having concave shapes are provided and open to the both circumferential sides of the bottom portion 22*f*. Accordingly, hydraulic fluid is introduced rapidly into the end portion 80*a* of the lock plate 80. Therefore, time for retracting the lock plate 80 from the receiving portion 22 may be reduced. Further, the height of the projecting portion 22*a* is lower than the radial height of an opening 22*g* of the bottom portion 22*f* of the hydraulic pressure groove 22*b*. Here, in view of the strength and forming characteristics of the hydraulic pressure groove 22*b* in sintering, or the like, the vertical cross sectional shape of a circumferential wall of the hydraulic pressure groove 22*b* relative to the axial direction may have a round shape as shown in FIG. 5.

Figure 4:
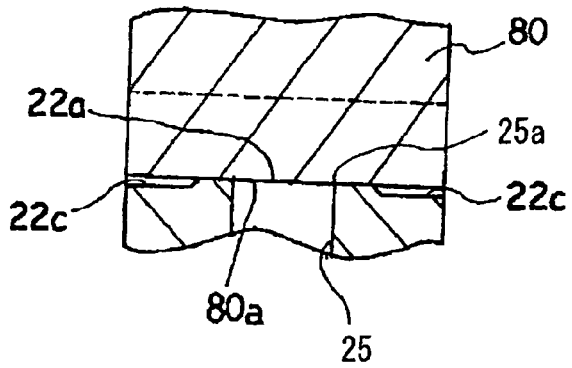
FIG. 4 shows a cross-sectional view taken on line IV—IV of FIG. 3.

As shown in FIGS. 3 and 4, a connecting groove 22*c* is open to a bottom portion 22*f* of the receiving portion 22 for connecting with the hydraulic pressure groove 22*b*. The connecting groove 22*c* may be provided at at least one side of the projection portion 22*a* in the axial direction. Further, since the connecting groove 22*c* is open to the end surface of the rotor 20, the connecting groove 22*c* may be formed easily by sintering, or the like, by moving a mold in one direction. Since the connecting groove 22*c* is formed at the projecting portion 22*a*, hydraulic pressure can be introduced rapidly to the end portion 80*a* of the lock plate 80. Further, since the area of the end portion 80*a* of the lock plate 80 contacting hydraulic fluid becomes large, hydraulic pressure for separating the lock plate 80 from the projecting portion

22*a* is increased and time for retracting the lock plate 80 from the receiving portion 22 can be reduced.

As shown in FIG. 2, each vane 70 is inserted into each vane groove 21, and the each vane 70 is movably positioned within each of four hydraulic pressure chambers R0 formed between the housing 30 and the rotor 20. The vane 70 divides the hydraulic pressure chamber R0 into an advance angle hydraulic chamber R1 and a retard angle hydraulic chamber R2. A vane spring 73 (shown in FIG. 1) is provided between the bottom portion of the vane groove 21 and the bottom surface of the vane 70, for biasing each of four vanes 70 movably attached to each vane groove 21 in the radial direction.

As shown in FIG. 2, hydraulic fluid (hydraulic pressure) is supplied to and drained from the four retard angle hydraulic chamber R2 formed by being separated by each vane 70 through the retard angle passage 11 and an retard angle hydraulic passage 23. Further, hydraulic fluid (hydraulic pressure) is supplied to and drained from three chambers of four advance angle hydraulic chambers R1 through the advance angle passage 12 and an advance angle hydraulic passage 24. Hydraulic fluid (hydraulic pressure) is supplied to and drained from one advance angle hydraulic chamber R1 except the stated three chambers R1 through the hydraulic fluid groove 24*a* connecting the lock hydraulic passage 25 provided at the bottom portion 22*f* of the receiving portion 22 and the advance angle hydraulic chamber R1 after the lock plate 80 is moved by being supplied hydraulic fluid (hydraulic pressure) from the lock hydraulic passage 25. Accordingly, the advance angle hydraulic passage 24 is not provided and the lock hydraulic passage 25 is utilized for one advance angle hydraulic chamber R1, and the structure of the hydraulic pressure circuit is simplified.

The front plate 40 and the rear plate 50 having ring shapes are welded together at both sides of the housing 30 in the axial direction and integrally assembled by five connecting bolts 92. Plural timing sprockets 31 are formed at an outer circumference of a end portion of the housing 30 in the axial direction, the end portion of the housing 30 being contacted with the rear plate 50. Each of five projecting portions 33 is formed projecting from the circumference side to the inside of the housing 30 in circumference direction. Each inner circumferential surface of these projecting portions 33 is slidably engaged with the outer circumferential surface of the inner rotor 20, and the housing 30 is pivotally supported about the rotor 20. Further, each lateral surface 33*a* of each projecting portion 33A of five projecting portions 33 contacts with each lateral surfaces 70*a* of the vane 70A for straining an rotating angular range between the housing 30 and the rotor 20 toward the advance angle direction. Further, each lateral surfaces 33*b* of a each projecting portions 33B contacts with each lateral surfaces 70*b* of the vanes 70B for straining an rotating angular range between the housing 30 and the rotor 20 in the retarding direction. An accommodating groove 34 for accommodating the lock plate 80 is provided between two projecting portions 33 of five projecting portions 33. In addition, an accommodating hole 35 for accommodating a coil spring 81 biasing the lock plate 80 in the radial direction, the accommodating hole 35 being connected to the accommodating groove 34, is also provided between the two projecting portions 33 of five projecting portions 33. Further, each of the mentioned four hydraulic pressure chamber R0 is formed between respective two projecting portions 33 of five projecting portions 33.

As shown in FIG. 2, the end portion 80*a* of the lock plate 80 is advanced into the receiving portion 22 in case the relative rotation between the rotor 20 and the housing 30 is restricted.

One end of the torsion spring 60 is engaged with the front plate 40 and the other end of the torsion spring 60 is engaged with the internal rotor 20. The rotor 20 is biased toward the advance angle direction (clockwise direction of FIG. 2) relative to the housing 30, the front plate 40, and the rear plate 50. Accordingly, the efficiency of responding and operating toward the advance angle direction of the rotor 20 is improved.

The operation of the valve opening-closing timing control device 1 structured above will be explained as follows. In case the internal combustion engine is not running, the hydraulic pump 205 is not operated and electricity is not applied to the directional control valve 200. Therefore, hydraulic fluid (hydraulic pressure) is not supplied to the hydraulic pressure chamber R0. In this time, as shown in FIG. 2, the end portion 80*a* of the lock plate 80 is advanced into the receiving portion 22 of the rotor 20 to lock the rotor 20. Accordingly, the relative rotation between the rotor 20 and the housing 30 is restricted. Even when the internal combustion engine is started and the hydraulic pump 205 is operated, since hydraulic fluid (hydraulic pressure) supplied from the hydraulic pump 205 is substantially supplied only to the retard angle hydraulic chamber R2 through the connection passage 16, the retard angle passages 11, and the retard angle hydraulic passage 23 while the duty ratio of electrification of the directional control valve 200 is small (the ratio of the electrified time to the non-electrified time per unit time is small), the valve opening-closing timing control device 1 remains to be a lock condition.

Depending on the driving condition of the internal combustion engine, if the advance angle condition is needed for opening and closing valve, the duty ratio of electrifying the directional control valve 200 is increased and the position of the spool 204 is switched. Hydraulic fluid (hydraulic pressure) supplied from the hydraulic pump 205 is supplied through the connection passage 15, the advance angle passage 12, and the advance angle hydraulic passage 24 to the advance angle hydraulic chamber R1. Hydraulic fluid (hydraulic pressure) supplied from the hydraulic pump 205 is also supplied through the hydraulic fluid groove 24*a* after supplied to the receiving portion 22 from the lock hydraulic passage 25. Here, hydraulic fluid (hydraulic pressure) supplied to the receiving portion 22 from the lock hydraulic passage 25 flows into the hydraulic pressure groove 22*b* formed in both circumferential sides of the bottom portion 22*f* and flows in the axial direction of the bottom portion 22*f* along the hydraulic pressure groove 22*b*. Hydraulic fluid which flowed in the axial direction of the bottom portion 22*f* flows in the circumferential direction through the connecting groove 22*c* and introduced into the end portion 80*a* of the lock plate 80. Accordingly, the area of flowing passage supplying hydraulic fluid into the end portion 80*a* of the lock plate 80 is enlarged by the hydraulic pressure groove 22*b* and the connecting groove 22*c*, thus hydraulic fluid can be rapidly introduced into the end portion 80*a*. Further, since the area of the end portion 80*a* of the lock plate 80 contacting with hydraulic fluid is provided, hydraulic pressure for releasing the lock plate 80 can be more increased than that of conventional technique. The whole area of the end portion 80*a* of the lock plate 80 contacts the bottom portion 22*f* of the receiving portion 22 in the conventional technique. In other words, while the lock plate 80 contacts with the top end face 22*e*, the space S is formed around the projecting portion 22*a*. Accordingly, hydraulic fluid flows into the space S, hydraulic pressure influences the end portion 80*a*, and the lock plate 80 can be separated from the projecting portion 22*a*. Therefore, time for retracting the lock plate 80 from the receiving portion 22 can be reduced. Accordingly, before the housing 30 and the rotor 20 starts relative rotating, sufficient hydraulic pressure is applied to the end portion 80*a* of the lock plate 80 to be retracted from the receiving portion 22. Thus, a malfunction of releasing the lock condition caused by the lock plate 80 being held between the rotor 20 and the housing 30 and being insufficiently retracted from the receiving portion 22 can be avoided. As mentioned above, hydraulic fluid introduced into the receiving portion 22 operates the lock plate 80 to be accommodated in the accommodating groove 34 of the housing 30 and supplied into the advance angle hydraulic chamber R1 through the hydraulic fluid groove 24*a*. Above mentioned hydraulic fluid supplied into the advance angle hydraulic chamber R1, as well as hydraulic fluid supplied into the advance angle hydraulic chamber R1 through the advance angle hydraulic passage 24, rotates a rotor member 2 in the advance angle direction to the housing member 3.

On the other hand, hydraulic fluid (hydraulic pressure) in the retard angle hydraulic chamber R2 is discharged from the discharge port 207 of the directional control valve 200 through the retard angle hydraulic passage 23, the retard angle passage 11, and the connection passage 16. Thus, the rotor 20 is rotated relative to the housing 30 in advance angle direction. The lateral face 33*a* of the projecting portion 33A of the housing 30 contacts with the lateral surface 70*a* of the vane 70A, thus the rotation of the rotor 20 relative to the housing 30 in the advance angle direction is restricted.

Then, if retard angle condition is needed for opening and closing valve, the duty ratio of electrifying the directional controlling valve 200 is decreased to switch the position of the spool 204. The hydraulic fluid (hydraulic pressure) supplied from the hydraulic pump 205 is supplied into the retard angle hydraulic chamber R2 through the connection passage 16, the retard angle passage 11, and the retard angle hydraulic passage 23. On the other hand, hydraulic fluid (hydraulic pressure) of the advance angle hydraulic chamber R1 is discharged from the discharge port 207 of the directional controlling valve 200 through the hydraulic fluid groove 24*a*, the receiving portion 22, and the lock hydraulic passage 25, as well as the advance angle hydraulic passage 24, the advance angle passage 12, and the connection passage 15. Thus, the rotor 20 is rotated relative to the housing 30 in retard angle direction (the counterclockwise direction of FIG. 2). The lateral face 70*b* of the vane 70B contacts with the lateral face 33*b* of the projecting portion 33B of the housing 30, thus the rotation of the rotor 20 relative to the housing 30 in the retard angle direction is restricted. Here, when hydraulic fluid (hydraulic pressure) is discharged from the receiving portion 22, the lock plate 80 movably provided in the housing 30 is advanced into the receiving portion 22 to restrict the relative rotation between the housing 30 and the rotor 20.

Here, the relative rotational position between the rotor 20 and the housing 30 can be determined in an arbitrary position, for example, middle position between the most retard angle position and the most advance angle position by controlling the duty ratio of the directional control valve 200.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the sprit of the present invention. Accordingly, it is expressly intended that all such variations, changes and equivalents which fall within the spirit and scope of the present invention as defined in the claims, be embraced thereby.

What is claimed is:

1. A valve opening-closing timing control device, comprising:

a housing member rotating together with one of a cam shaft and a crank shaft of a combustion engine;

a rotor member rotatably attached to said housing member; and rotating together with the other of said crank shaft and said cam shaft;

a hydraulic pressure chamber formed between said housing member and said rotor member; the hydraulic pressure chamber being divided into an advance angle hydraulic chamber and a retard angle hydraulic chamber by a vane integrally provided with said rotor member;

a lock mechanism including a lock member movably provided at the housing member and a receiving portion formed at said rotor member for receiving the lock member, whereby the lock mechanism restricts a relative rotation between the rotor member and the housing member by advancing the lock member into the receiving portion and allows the relative rotation between the rotor member and the housing member by retracting the lock member from the receiving portion;

a hydraulic pressure circuit for supplying hydraulic fluid to said advance angle hydraulic chamber, said retard angle hydraulic chamber, and said lock mechanism; and a projecting portion formed at a bottom of said receiving portion and including a top end face smaller than a sectional area of said lock member.

2. The valve opening-closing timing control device according to claim 1, wherein:

an hydraulic passage is connected to said bottom via an opening portion having larger circumferential width than width of said top end face.

3. The valve opening-closing timing control device according to claim 2, wherein:

the area of said top end face of the projecting portion is smaller than that of an end portion of said lock member.

4. The valve opening-closing timing control device according to claim 3, wherein:

the width of said top end face of the projecting portion is smaller than circumferential width of said lock member.

5. The valve opening-closing timing control device according to claim 4, wherein:

said receiving portion penetrates said rotor member in axial direction.

6. The valve opening-losing timing control device according to claim 5, wherein:

a hydraulic pressure groove having a concave shape is open to the bottom of the receiving portion in the circumferential direction.

7. The valve opening-closing timing control device according to claim 6, wherein:

at least one connecting groove is formed in said projecting portion and is connected to said hydraulic pressure groove.

8. The valve opening-closing timing control device according to claim 7, wherein:

said at least one connecting groove is formed in at least one end of said projecting portion in the axial direction.

9. The valve opening-closing timing control device according to claim 8, wherein:

said at least one connecting groove is open to one end surface of said rotor member.

10. The valve opening-closing timing control device according to claim 9, wherein:

the height of said projecting portion is lower than radial height of an opening provided at said bottom of said hydraulic pressure groove.

11. The valve opening-losing timing control device according to claim 10, wherein:

a circumferential wall of said hydraulic pressure groove has a round shape.

12. The valve opening-closing timing control device according to claim 6, wherein:

width of said receiving portion is larger than the circumferential width of said lock member.

13. The valve opening-closing timing control device according to claim 4, wherein:

a vertical cross-section of said projecting portion has a trapezoidal shape in vertical cross section relative to axial direction.

* * * * *